US005290000A

United States Patent [19]

Hochstein et al.

[11] Patent Number: 5,290,000

[45] Date of Patent: Mar. 1, 1994

[54] WALL-MOUNT BRACKET FOR HAND SHOWER OR THE LIKE

[75] Inventors: Detlef Hochstein, Hemer; Christian Frankholz, Schwerte, both of Fed. Rep. of Germany

[73] Assignee: Friedrich Grohe Akteingesellschaft, Hemer, Fed. Rep. of Germany

[21] Appl. No.: 909,615

[22] Filed: Jul. 7, 1992

[30] Foreign Application Priority Data

Jul. 23, 1991 [DE] Fed. Rep. of Germany ..... 4124354

[51] Int. Cl.[5] ..... E03C 1/06

[52] U.S. Cl. ..... 248/221.003; 248/223.4; 4/615

[58] Field of Search ..... 248/481, 221.3, 221.4, 248/223.4, 224.4, 220.2, 75; 4/615; 403/326, 329, 372

[56] References Cited

U.S. PATENT DOCUMENTS

| | | | |
|---|---|---|---|
| 1,794,700 | 3/1931 | McCaskey . | |
| 2,146,859 | 2/1939 | Seklehner | 248/481 X |
| 2,750,142 | 6/1956 | McKee | 248/222.1 |
| 5,020,293 | 6/1991 | Itagaki | 248/223.4 X |
| 5,040,712 | 8/1991 | Pesonen et al. | 248/221.3 X |
| 5,121,893 | 6/1992 | King et al. | 248/221.3 X |
| 5,199,277 | 4/1993 | Granström et al. | 248/221.4 X |

FOREIGN PATENT DOCUMENTS

| | | |
|---|---|---|
| 0277379 | 8/1988 | European Pat. Off. . |
| 7304867 | 5/1973 | Fed. Rep. of Germany . |
| 2459644 | 1/1981 | France . |
| 453237 | 6/1968 | Switzerland . |
| 515390 | 12/1971 | Switzerland . |

*Primary Examiner*—Rinaldi Rada

*Attorney, Agent, or Firm*—Herbert Dubno; Andrew Wilford

[57] ABSTRACT

A bracket assembly for securing a fitting to a wall. The assembly has a generally T-section plate having a pair of parallel T-flanges, fasteners securing the plate to the wall with the flanges substantially parallel to the wall, a holder adapted to carry the fitting and formed with a T-section slot open at one end, substantially complementary to the flanges of the plate, and normally receiving the plate, and an elastically deflectable latching tongue formed on the holder at the one end and retaining the holder and plate together. Spring formations resiliently engaged between the plate and the holder retain same snugly together. These formations are elastically deformable ribs on the flanges of the plate. The ribs are unitarily formed with the flanges.

4 Claims, 3 Drawing Sheets

WALL-MOUNT BRACKET FOR HAND SHOWER OR THE LIKE

FIELD OF THE INVENTION

The present invention relates to a wall-mount bracket for securing a fixture to a wall. More particularly this invention concerns such a bracket used to hold a hand shower.

BACKGROUND OF THE INVENTION

A bracket for mounting a hand shower or the like on a wall surface typically has a backing plate that is secured to the wall, typically by screws, and a holder body that is then secured to the backing plate. German utility model 7,304,867 describes such an arrangement where the backing plate is formed with a dovetail groove in which a dovetail ridge of the holder fits. Another element secures these two parts together against relative movement.

OBJECTS OF THE INVENTION

It is an object of the present invention to provide an improved wall-mount bracket for a hand shower or the like.

Another object is the provision of such an improved wall-mount bracket for a hand shower or the like which is of simple construction and which is easy to install and remove.

SUMMARY OF THE INVENTION

A bracket assembly for securing a fitting to a wall has according to the invention a generally T-section plate having a pair of parallel T-flanges, fasteners securing the plate to the wall with the flanges substantially parallel to the wall, a holder adapted to carry the fitting and formed with a T-section slot open at one end, substantially complementary to the flanges of the plate, and normally receiving the plate, and an elastically deflectable latching tongue formed on the holder at the one end and retaining the holder and plate together.

This arrangement is extremely simple. It can be snapped together relatively simply. Once assembled it is very neat and strong, and it can easily be disassembled.

According to a further feature of this invention spring formations resiliently engaged between the plate and the holder retain same snugly together. These formations are elastically deformable ribs on the flanges of the plate. The ribs are unitarily formed with the flanges.

In the bracket assembly of the invention holder and plate are each unitarily formed of a synthetic resin.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
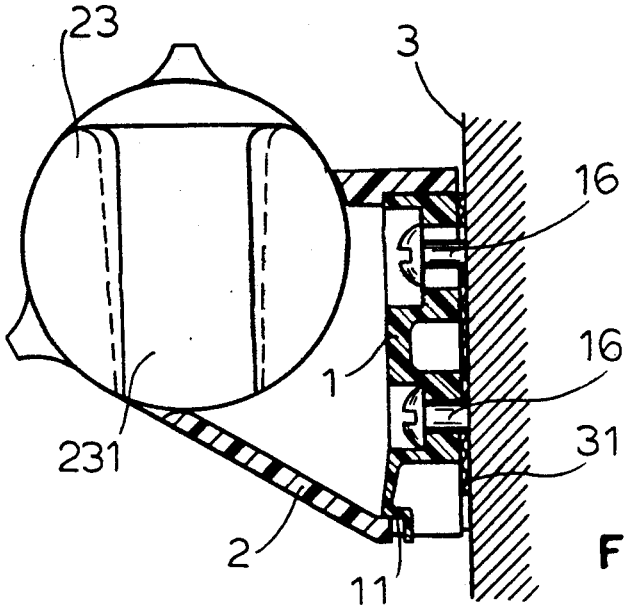
FIG. 1 is a vertical section through the bracket assembly according to the invention.
Figure 2:
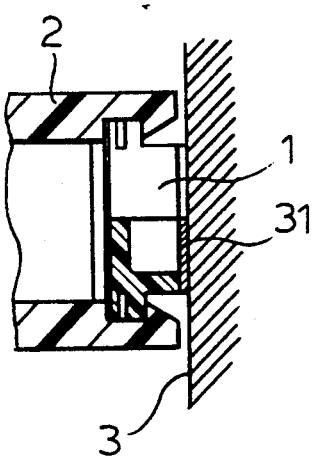
FIG. 2 is a partly sectional view of a detail of FIG. 1.

As seen in FIGS. 1 and 2 a bracket assembly for a hand-shower clip 23 having a holder seat 231 basically comprises a plate 1 secured by screws 16 to a wall 3, and a holder body 2 releasably secured to the wall plate 1 and itself carrying the clip 23. The clip 23 itself is adapted to hold the tapered stem formed at one end of a hand shower so it can be mounted on the wall 3 for stationary use. The hand shower can be of the type described in copending application Ser. No. 07/909,956 filed Jul. 7, 1992.

Figure 3:
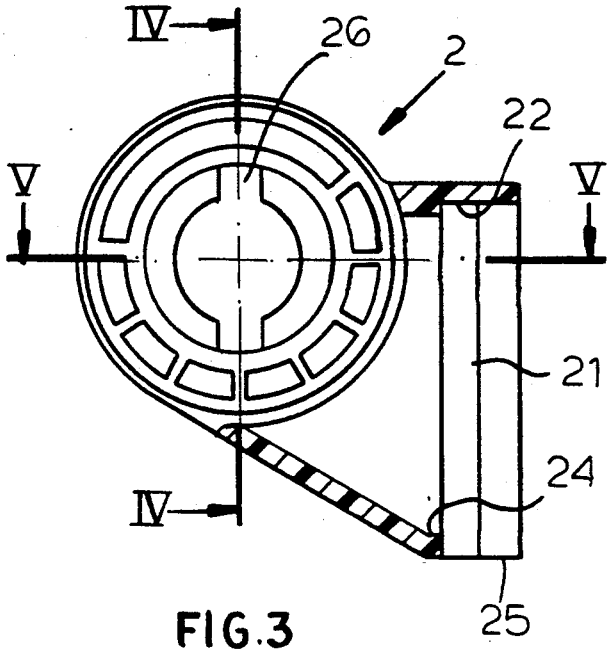
FIG. 3 is a vertical section through the holder of the assembly.
Figure 4:
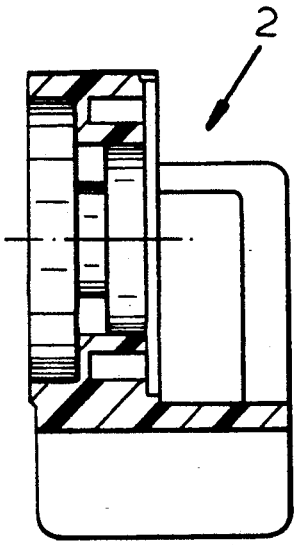
FIGS. 4 and 5 are sections taken respectively along lines IV—IV and V—V of FIG. 3.
Figure 5:
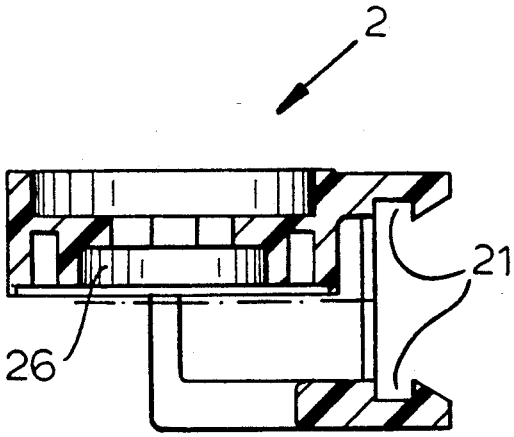

As seen in FIGS. 3 through 5 the holder 2 is unitarily made of one piece of a durable synthetic resin and has a rear side formed with a downwardly open T-section slot 21 bounded at its upper end by a flange 22. This holder 2 also has a socket 26 into which the clip 23 fits for some angular adjustment of a hand shower held in the seat 231.

Figure 6:
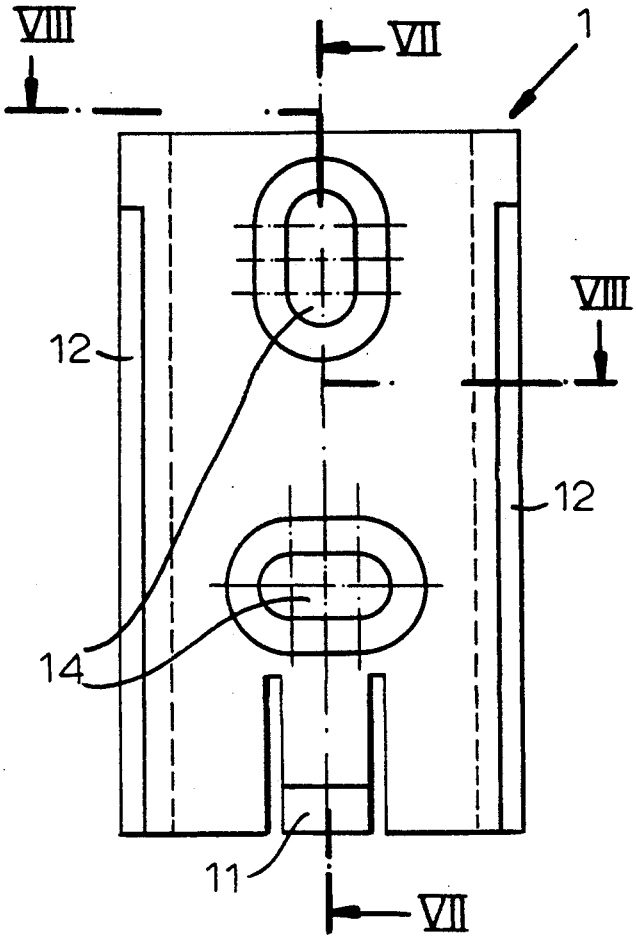
FIG. 6 is a front view of the wall plate of the assembly.
Figure 7:
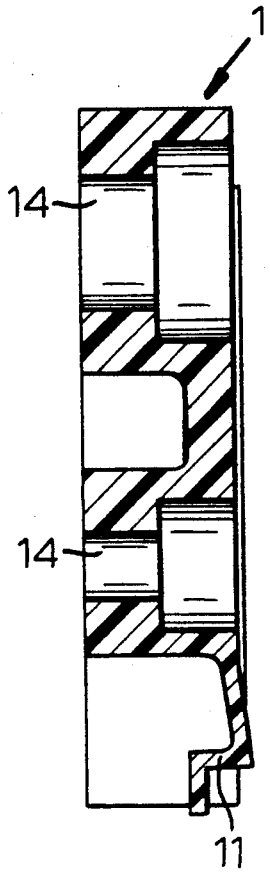
FIGS. 7 and 8 are sections taken respectively along lines VII—VII and VIII—VIII of FIG. 6.
Figure 8:
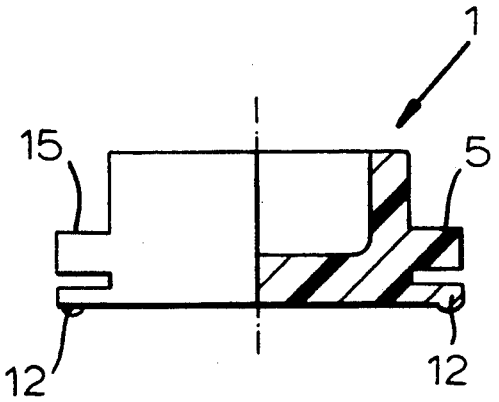

The wall plate 1 as shown in FIGS. 6 through 8 is basically rectangular seen from the front but of T-section seen from above or below. It is unitarily made of a durable synthetic resin and has two stiff ribs or flanges 15 each associated with a thin flange 12 and adapted to fit in the T-slot 21 of the holder 2. Furthermore the plate 1 is formed with two holes 14, one a vertically oriented slot and the other a horizontally oriented one. The plate 1 further is formed at one end with a deflectable locking tab 11. When the holder 2 is fitted over the plate 1 the upper end of the plate 1 abuts the flange 22 and the lower edge of the tab 11 comes to rest atop a lower retaining surface 24 of the holder 2.

The bracket assembly of this invention is installed as follows:

First two holes are drilled in the wall 3 and normally also provided with screw anchors. Then a rubber backing sheet 31 is fitted to the back of the plate 1 and it is screwed to the wall 3. The different orientations of the slots 14 ensures that even if the holes are not perfectly located, it will be possible to set the plate 1 plumb.

The holder 2 is then slipped down over the plate 1 until the upper end of the plate 1 abuts the flange 22 and the tab 11 snaps over the lower edge 24. This locks the two parts 1 and 2 together. The screws 16 are covered and, in fact, virtually the entire plate 1 is hidden from view.

To remove the holder 2 the tab 11 is pressed inward, for example by a screwdriver, and the holder 2 is pushed up.

We claim:

1. A bracket assembly for securing a fitting to a wall, the assembly comprising:

a generally T-section plate having a pair of parallel T-flanges;

fasteners securing the plate to the wall with the flanges substantially parallel to the wall;

a holder adapted to carry the fitting and formed with a T-section slot open at one end, substantially complementary to the flanges of the plate, and normally receiving the plate;

an elastically deformable rib on each of the flanges of the plate resiliently engaged between the plate and the holder for retaining the plate and the holder snugly together; and an elastically deflectable latching tongue formed on the holder at the one end and retaining the holder and plate together.

2. The bracket assembly defined in claim 1 wherein the ribs are unitarily formed with the flanges.

3. The bracket assembly defined in claim 1 wherein the holder and plate are each unitarily formed of a synthetic resin.

4. A bracket assembly for securing a hand-shower clip to a wall, the assembly comprising:

a generally T-section plate having a pair of parallel T-flanges each having a thick relatively stiff rib portion and a thin elastically deformable rib portion;

fasteners securing the plate to the wall with the flanges substantially parallel to the wall;

a holder adapted to carry the clip and formed with a T-section slot open at one end, substantially complementary to the flanges of the plate, and normally receiving the plate with some elastic deformation of the thin rib portions; and an elastically deflectable latching tongue formed on the holder at the one end and retaining the holder and plate together.

* * * * *